US010627096B2

(12) United States Patent
Bukkems et al.

(10) Patent No.: US 10,627,096 B2
(45) Date of Patent: Apr. 21, 2020

(54) LIGHTING DEVICE

(71) Applicant: SIGNIFY HOLDING B.V., Eindhoven (NL)

(72) Inventors: Peter Johannes Martinus Bukkems, Eindhoven (NL); Johannes Petrus Maria Ansems, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/778,590

(22) PCT Filed: Nov. 15, 2016

(86) PCT No.: PCT/EP2016/077668

§ 371 (c)(1),
(2) Date: May 23, 2018

(87) PCT Pub. No.: WO2017/089170

PCT Pub. Date: Jun. 1, 2017

(65) Prior Publication Data

US 2018/0347799 A1 Dec. 6, 2018

(30) Foreign Application Priority Data

Nov. 26, 2015 (EP) ..... 15196494

(51) Int. Cl.
*F21V 29/507* (2015.01)
*F21V 3/02* (2006.01)
(Continued)

(52) U.S. Cl.
CPC ..... *F21V 29/507* (2015.01); *F21K 9/232* (2016.08); *F21V 3/02* (2013.01); *F21V 5/02* (2013.01);
(Continued)

(58) Field of Classification Search
CPC ..... F21V 29/506; F21V 29/507; F21V 29/70; F21V 3/02; F21V 5/02; F21K 9/232; F21Y 2115/10; F21W 2121/04
See application file for complete search history.

(56) References Cited

U.S. PATENT DOCUMENTS 7,241,032 B2 * 7/2007 Qingbiao ..... F21V 3/00 362/382
8,070,347 B1 * 12/2011 Lin ..... F21V 31/00 362/391
(Continued)

FOREIGN PATENT DOCUMENTS

CN 102720961 A 10/2012
CN 202852682 U 4/2013
(Continued)

*Primary Examiner* — Peggy A Neils
(74) *Attorney, Agent, or Firm* — Akarsh P. Belagodu

(57) ABSTRACT

A lighting device comprising at least one light source (4) adapted for, in operation, emitting light, a heat sink element (3) comprising a first part (31) on which the at least one light source is arranged and a second part (32), the second part comprising a plurality of ribs (341, 342, 343, 344) extending from the first part, and a cover element (2) comprising an outer surface (21) adapted for forming a light exit surface of the lighting device, the cover element (2) comprising a first plurality of grooves (231, 232, 233) comprising a V-shaped cross-section and being provided in the outer surface of the cover element, the cover element being arranged such as to extend over the heat sink element in such a way that the first plurality of grooves extends over the plurality of ribs of the second part of the heat sink element.

15 Claims, 6 Drawing Sheets

(51) Int. Cl.

| | |
|---|---|
| ***F21V 5/02*** | (2006.01) |
| ***F21V 29/506*** | (2015.01) |
| ***F21K 9/232*** | (2016.01) |
| ***F21V 29/70*** | (2015.01) |
| ***F21Y 115/10*** | (2016.01) |

(52) U.S. Cl.
CPC ..... *F21V 29/506* (2015.01); *F21V 29/70* (2015.01); *F21Y 2115/10* (2016.08)

(56) References Cited

U.S. PATENT DOCUMENTS

| | | | | |
|---|---|---|---|---|
| 8,680,754 | B2 * | 3/2014 | Premysler | F21V 3/02 313/46 |
| 8,746,953 | B1 * | 6/2014 | Shao | F21V 1/00 362/311.02 |
| 8,948,564 | B1 | 2/2015 | Sherman et al. | |
| 9,303,857 | B2 | 4/2016 | Desilva et al. | |
| 9,435,492 | B2 * | 9/2016 | Heikman | F21V 29/004 |
| 9,702,512 | B2 * | 7/2017 | Power | F21K 9/90 |
| 2012/0262050 | A1 | 10/2012 | Fan | |
| 2012/0287652 | A1 | 11/2012 | Breidenassel et al. | |
| 2012/0307498 | A1 | 12/2012 | Lo et al. | |
| 2013/0070478 | A1 * | 3/2013 | Edamitsu | G02B 5/0231 362/608 |
| 2014/0218931 | A1 | 8/2014 | Desilva et al. | |

FOREIGN PATENT DOCUMENTS

| | | | |
|---|---|---|---|
| CN | 204153690 | U | 2/2015 |
| DE | 202004012513 | U1 | 12/2004 |
| DE | 202010005312 | U1 | 9/2010 |
| JP | 2012064362 | A | 9/2010 |
| WO | WO2012163535 | A1 | 12/2012 |
| WO | WO2014037908 | A1 | 3/2014 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2016/077668, filed on Nov. 15, 2016, which claims the benefit of European Patent Application No. 15196494.7, filed on Nov. 26, 2015. These applications are hereby incorporated by reference herein.

FIELD OF THE INVENTION

The invention relates to a lighting device comprising at least one light source adapted for, in operation, emitting light, a heat sink element and a cover element.

BACKGROUND OF THE INVENTION

In many different applications the visual appearance of such a lighting device is of high importance. This is especially the case in applications where the lighting devices are directly visible such as is often the case with for example chandeliers where the lighting devices are provided in the form of light bulbs. Therefore the construction and design of lighting devices is a very important issue within the field of luminaire design.

A side effect in such lighting devices is that excess heat is produced, especially in high lumen lighting devices. This excess heat must be removed to avoid adverse effects on the lighting device. To remove the excess heat a heat sink is provided. The larger the lumen output of the lighting device the larger the heat sink necessarily becomes. This has the drawback that at least a part, and most often a major part, of the heat sink is visible, which from a user's point of view gives the impression that the lighting device emits light from only a limited part of the surface of the cover element. This is neither practically nor aesthetically satisfactory.

US 2012/0307498 A2 describes one attempt at solving the above problems by providing a LED lighting device comprising a plurality of light sources, a primary heat sink and a secondary heat sink and a globe portion made of glass. The secondary heat sink, which is a metal conductor, is provided in association with the glass globe. The glass globe may be frosted or otherwise light diffusive.

Even if this construction in the case the glass globe is actually frosted or otherwise light diffusive to some extend provides a hiding effect with respect to the secondary heat sink, the secondary heat sink will still be at the least partially visible from a user's point of view.

Therefore, there is a desire and need for providing a lighting device which from a user's point of view emits light from the major part of or even the entire surface of the cover element, in which the excess heat produced is nevertheless removed, even in case of high lumen lighting devices, and which is furthermore versatile in terms of design options.

SUMMARY OF THE INVENTION

It is an object of the present invention to overcome this problem, and to provide a lighting device in which the invisibility of the heat sink element from the outside during use is improved such that when seen from a user's point of view the lighting device emits light from the major part of or even the entire surface of the cover element, in which the excess heat produced is nevertheless removed, even in case of high lumen lighting devices, and which is furthermore versatile in terms of design options.

According to a first aspect of the invention, this and other objects are achieved by means of a lighting device comprising at least one light source adapted for, in operation, emitting light, a heat sink element comprising a first part on which the at least one light source is arranged and a second part, the second part comprising a plurality of ribs extending from the first part, and a cover element comprising an outer surface adapted for forming a light exit surface of the lighting device, the cover element comprising a first plurality of grooves comprising a V-shaped cross-section and being provided in the outer surface of the cover element, the cover element being arranged such as to extend over the heat sink element in such a way that the first plurality of grooves extends over the plurality of ribs of the second part of the heat sink element.

Providing a cover element comprising a first plurality of grooves comprising a V-shaped cross-section and being provided in an outer surface of the cover element provides for a lighting device with which it becomes possible to visually remove at least a part of the heat sink, i.e. to make at least a part of the heat sink invisible seen from a user's point of view, and which is furthermore highly versatile in terms of design options.

Especially, everything arranged directly below such grooves will be hidden when seen from the outside. Therefore, combining the provision of such grooves with the provision of a heat sink element comprising a second part with a plurality of ribs extending from the first part and arranging the cover element such as to extend over the heat sink element in such a way that the first plurality of grooves extends over the plurality of ribs of the second part of the heat sink element, provides for a lighting device that will give the appearance of emitting light from the entire part of the outer surface of the cover element extending over the plurality of ribs of the second part of the heat sink element, or at least from a very large part of this part of the outer surface, and in which the excess heat produced by the light sources is nevertheless removed, even in case of high lumen lighting devices.

Thus, in virtue of the above-mentioned features a lighting device is provided in which the invisibility of the heat sink element from the outside during use is improved to the point where the heat sink element is barely visible from the outside such that when seen from a user's point of view the lighting device emits light from the major part of or even the entire surface of the cover element, but in which the excess heat produced is nevertheless removed, even in case of high lumen lighting devices, thus avoiding the adverse effects on the lighting device otherwise caused by heating.

In an embodiment the cover element further comprises a second plurality of grooves comprising a V-shaped cross-section and being provided in the outer surface of the cover element and arranged such that the grooves of the second plurality of grooves intersect the grooves of the first plurality of grooves in an angle being different from zero, the cover element being arranged such as to extend over the heat sink element in such a way that the first plurality of grooves and the second plurality of grooves extends over the plurality of ribs of the second part of the heat sink element.

In an embodiment the grooves of the second plurality of grooves intersect the grooves of the first plurality of grooves in an angle of 90°. Thereby, a particularly thorough coverage of the outer surface of the cover element with the grooves of the first and second plurality of grooves is obtained.

In any event the provision of a second plurality of grooves provides for a lighting device in which the invisibility of the heat sink element from the outside during use is improved even further, especially in the case where the grooves do not necessarily extend in parallel with the ribs of the heat sink element, but in which the excess heat produced is nevertheless removed, even in case of high lumen lighting devices, thus avoiding the adverse effects on the lighting device otherwise caused by heating.

In an embodiment the first part of the heat sink element comprises a plurality of indentations provided in such a way as to extend between the ribs.

Providing a heat sink element comprising a first part with a plurality of indentations provided in such a way as to extend between the ribs provides for a lighting device that will furthermore give the appearance of emitting light from the entire part of the outer surface of the cover element extending over these indentations without compromising the heat conducting effect of the heat sink element.

In an embodiment the V-shaped cross section of each groove of the first and/or second plurality of grooves comprises two legs joined in an apex, and wherein the first and/or second plurality of grooves are arranged such that the apex points towards the heat sink element.

Such an orientation of the grooves provided in the outer surface of the cover element has proved to provide a particularly high degree of invisibility of the heat sink element from the outside during use.

In an embodiment the ribs of the plurality of ribs of the heat sink element are spaced apart with a distance being in the order of 8 mm.

Placing adjacent ribs of the heat sink element with a mutual spacing of 8 mm has been shown to provide the optimal combination of a heat sink element with as few ribs as possible and allowing for the provision of the plurality of indentations in the first part of the heat sink element while still providing the necessary amount of cooling of the lighting device. The ideal magnitude of the spacing between adjacent ribs does, however, depend on the thermal conductivity of the material used for the cover element. Thus, the said spacing of 8 mm has been shown to be particularly suitable in combination with cover elements made of transparent plastics of types normally used for light bulbs.

In an embodiment the cover element is arranged such as to extend over the heat sink element in such a way that each groove of the first plurality of grooves extends in parallel with and directly over a rib of the plurality of ribs of the second part of the heat sink element.

Thereby a lighting device is provided in which the invisibility of the heat sink element from the outside during use is virtually total. The result is a lighting device which has the visual impression of emitting light from virtually all of the outer surface and simultaneously being sufficiently cooled.

In an embodiment the cover element is arranged such as to extend over the heat sink element in such a way that each groove of the first plurality of grooves extends in an angle of 45° with and over the ribs of the plurality of ribs of the second part of the heat sink element and that each groove of the second plurality of grooves extends in an angle being different from zero with and over the ribs of the plurality of ribs of the second part of the heat sink element.

Thereby a lighting device is provided in which the invisibility of the heat sink element from the outside during use is very high and which furthermore provides for a variety of possible lighting device designs obtainable by choice of the orientation of the first plurality of grooves and in particular the second plurality of grooves with respect to the plurality of ribs.

In an embodiment the cover element comprises a bottom and a top and wherein at least one of the grooves of the first or second plurality of grooves are extending from the bottom or a position near the bottom to the top or a position near the top.

Thereby a lighting device is provided in which the invisibility of the heat sink element from the outside during use is improved even further as it is in this way ensured that the grooves extend over the ribs of the plurality of ribs of the second part of the heat sink element in the whole length thereof.

In an embodiment the cover element comprises a bottom and a top and wherein at least one of the ribs of the plurality of ribs and the grooves of the first and/or second plurality of grooves are extending along the shortest path from the bottom or a position near the bottom to the top or a position near the top.

Thereby a lighting device is provided which has a very simple construction, and which is very simple and cheap to produce.

In an embodiment the cover element comprises a bottom and a top and wherein at least one of the ribs of the plurality of ribs and the grooves of the first and/or second plurality of grooves are extending along a curved or winding path from the bottom or a position near the bottom to the top or a position near the top.

Thereby a lighting device is provided which has a very simple construction, and which is very simple and cheap to produce and which simultaneously provides for a variety of possible lighting device designs obtainable by choice of the particular path along which at least one of the ribs of the plurality of ribs and the grooves of the first and/or second plurality of grooves are extending.

In an embodiment the cover element further comprises a plurality of surface structures arranged on the outer surface of the cover element.

Thereby a lighting device is provided in which the invisibility of the heat sink element from the outside during use is improved even further due to the diffusing and/or glittering or sparkling effect obtained by such surface structures, and which simultaneously provides for a variety of possible lighting device designs obtainable by choice of the particular shape and properties of the surface structures.

In an embodiment the plurality of surface structures are shaped as a pyramid or a truncated pyramid.

Such a shape of the surface structures provided on the outer surface of the cover element has proved to provide a particularly high degree of invisibility of the heat sink element from the outside during use.

In an embodiment the plurality of surface structures being shaped as a pyramid or a truncated pyramid comprise a top angle of between 60° and 120°.

A top angle of between 60° and 120° of surface structures shaped as a pyramid or truncated pyramid has proved to provide an optimized degree of invisibility of the heat sink element from the outside during use.

In an embodiment the plurality of surface structures being shaped as a pyramid or a truncated pyramid comprise a top angle being in the order of 90°.

A top angle being in the order of 90° has further proved to provide the very best and most effective hiding of the heat sink element from the outside during use.

In an embodiment the plurality of surface structures taper in a direction towards an inner surface of the cover element.

Such an orientation of the surface structures provided on the outer surface of the cover element has proved to provide a particularly high degree of invisibility of the heat sink element from the outside during use.

In an alternative embodiment the plurality of surface structures taper in a direction away from an inner surface of the cover element.

Such an orientation of the surface structures provided on the outer surface of the cover element has proved to provide a very high degree of invisibility of the heat sink element from the outside during use.

In an embodiment the second part of the heat sink element further comprises a top element joining at least some of the ribs of the plurality of ribs at an end opposite to the first part.

Thereby a lighting device and in particular a heat sink element with a robust structure is provided for.

In an embodiment the minimal thickness of the cover element is 0.8 mm. Thereby the necessary safety requirements applicable for light bulbs are met.

In an embodiment the cover element is made of a plastic material or of glass.

In an embodiment the heat sink element is made of a heat conducting material such as a metal or an alloy.

In a further embodiment the heat sink element is a solid metal heat sink element.

It is noted that the aim of the particular construction of the heat sink element is to ensure that the heat generated by the light sources is spread over the whole surface of at least the cover element and for lighting devices of the light bulb type possibly also the metal socket element.

By way of example for a cover element made of a plastic material having moderate heat conducting properties, such a spreading of the heat requires a heat sink element with good heat conducting properties and with ribs having a cross-sectional surface area of 2 $mm^2$ or more.

It is furthermore noted that even though all lighting devices illustrated in the accompanying drawings are shown as candle-type lighting devices or more precisely candle-type light bulbs, the invention nevertheless is not limited to lighting devices of this type. Rather, lighting devices according to the invention may also be provided with any other suitable rounded shape commonly known in connection with light bulbs, or may indeed be any other suitable type of lighting devices.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
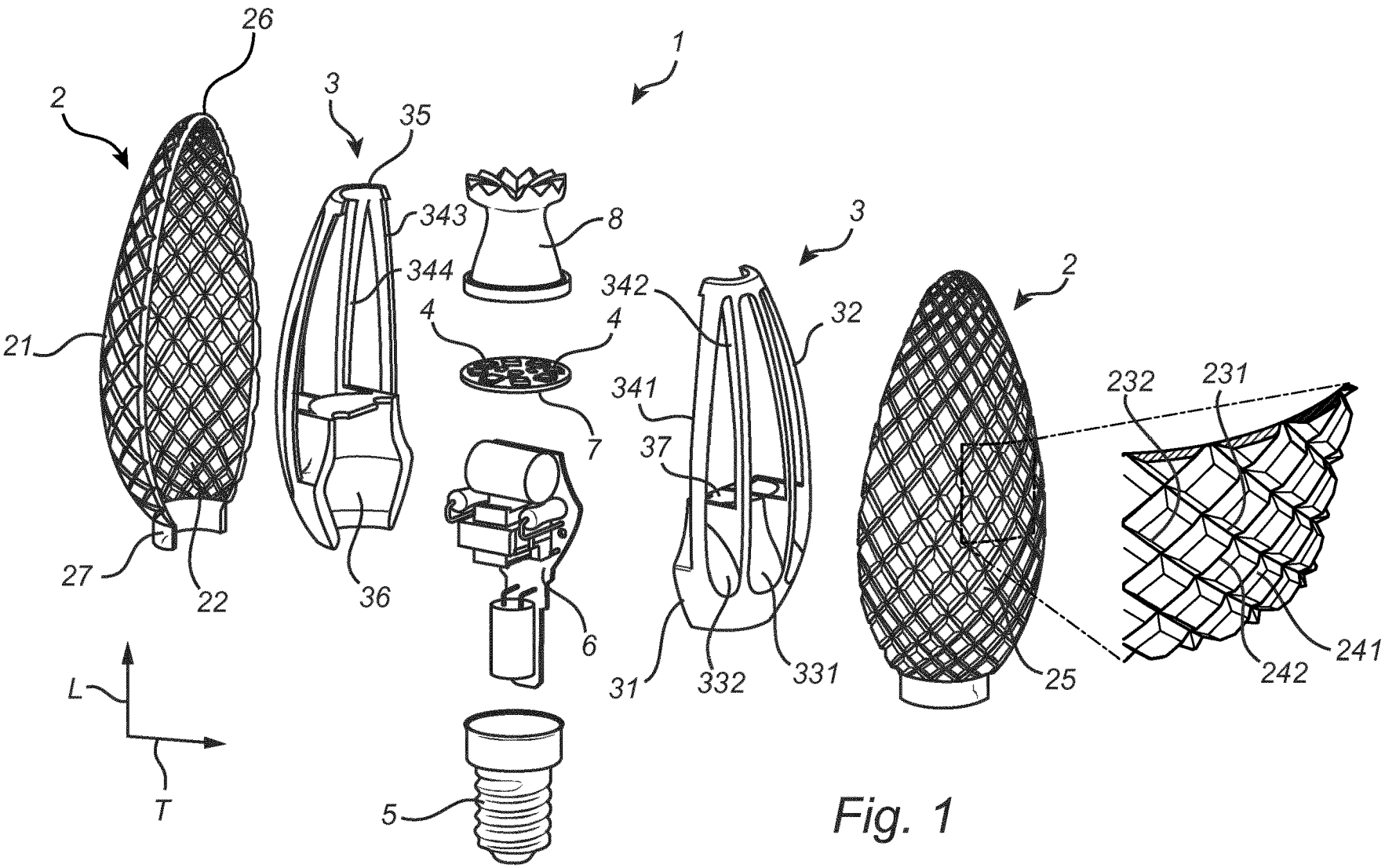
FIG. 1 shows an exploded view of a lighting device according to a first embodiment of the invention with an enlarged view of a section of the cover element added for further clarity.
Figure 2:
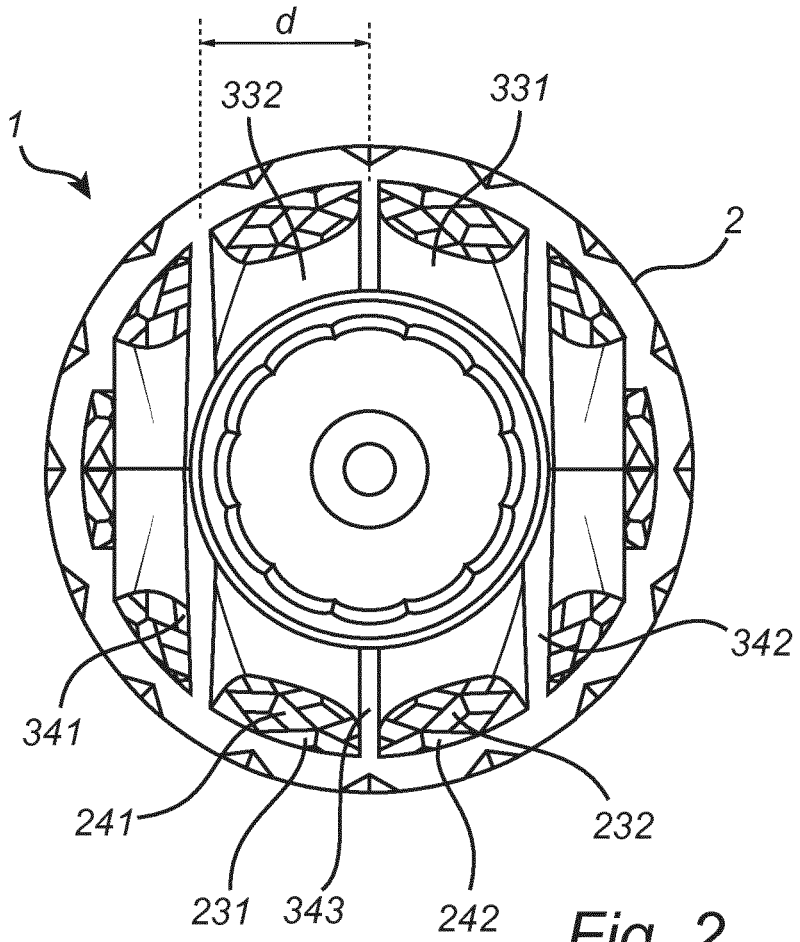
FIG. 2 shows a horizontal cross-sectional view of the lighting device according to FIG. 1 in an assembled state.
Figure 3:
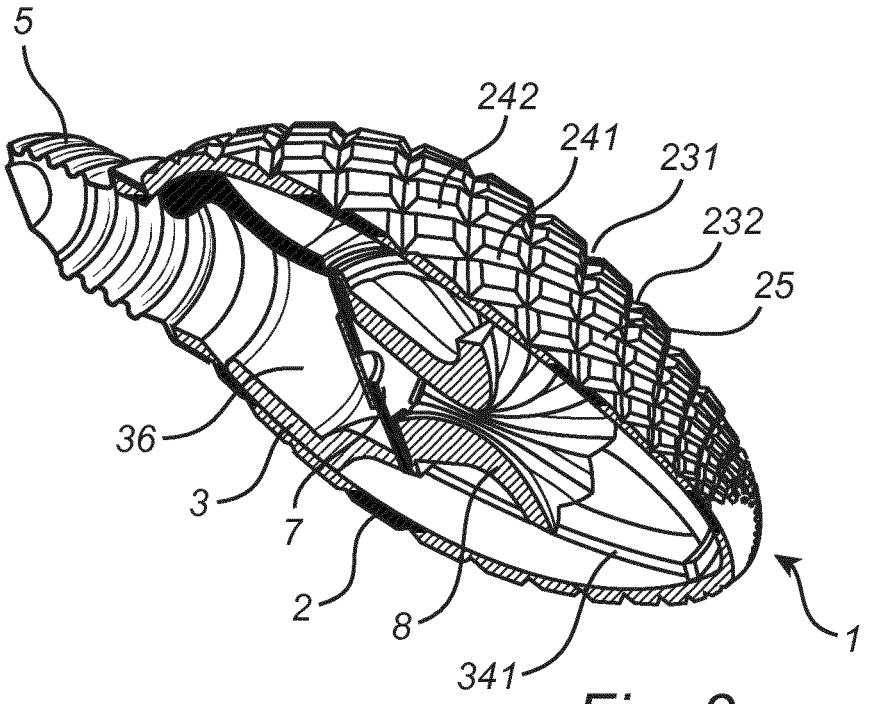
FIG. 3 shows a perspective cross-sectional view of the lighting device according to FIG. 1 in an assembled state.

FIG. 1 shows an exploded view of a lighting device 1 according to a first embodiment of the invention. FIGS. 2 and 3 show the lighting device 1 in an assembled state in a horizontal perspective cross sectional view, respectively.

The lighting device 1 comprises a plurality of light sources 4, a cover element 2 and a heat sink element 3. While not being limited thereto, in FIG. 1 both the cover element 2 and the heat sink element 3 is shown split along a longitudinal or vertical axis L in two halves adapted for being joined when assembling the lighting device 1. Advantages of splitting the cover element 2 and the heat sink element 3 in this way include that the lighting device 1 may be assembled easily in a simple sandwich-like manner and it allows ultrasonic welding to join the halves.

The plurality of light sources 4 are adapted for, in operation, emitting light. The light sources 4 are surface emitting light sources such as LEDs. The light sources 4 are arranged on a base 7, such as a printed circuit board, in a horizontal position, i.e. in parallel with a horizontal or transversal axis T (cf. FIG. 1). In an alternative embodiment the light sources 4 may be arranged on a base, such as a printed circuit board, in a vertical position, i.e. in parallel with a vertical or longitudinal axis L.

The heat sink element 3 comprises a lower part or first part 31 and an upper part or second part 32. The first part 31 and the second part 32 are provided in one piece.

The second part 32 comprises a plurality of ribs 341, 342, 343, 344 extending from the first part 31. More particularly, the plurality of ribs 341, 342, 343, 344 extend in a vertical or longitudinal direction L from the first part 31. Furthermore, and irrespective of the embodiment, the plurality of ribs 341, 342, 343, 344 are adapted to follow the curvature of the cover element 2.

With reference to FIG. 3, the ribs 341, 342, 343, 344 are arranged spaced apart with a distance d between adjacent ribs. The distance d is in one particular embodiment in the order of 8 mm.

It is noted that in other embodiments the plurality of ribs 341, 342, 343, 344 may extend in another direction from the first part 31 of the heat sink element 3, such as in a horizontal or transversal direction T, or even in a direction being inclined with respect to the longitudinal direction L and/or the transversal direction T.

The first part 31 comprises a plurality of indentations of which only indentations 331 and 332 are visible on FIG. 1. The plurality of indentations 331, 332 are provided in such a way as to extend between the ribs 341, 342, 343, 344. In alternative embodiments the plurality of indentations 331, 332 may be omitted.

Optionally, the heat sink element 3 may further comprise a top element 35 joining the plurality of ribs 341, 342, 343, 344 at an end opposite to the first part 31 of the heat sink element 3.

Irrespective of the embodiment the heat sink element 3 is made of a material with good heat conducting properties, such as a metal or an alloy, an example being aluminum.

The cover element 2 comprises an outer surface 21, an inner surface 22, a top 26 and a bottom 27. The cover element 2 further comprises a first plurality of grooves 231, 232 comprising a V-shaped cross-section and being provided in the outer surface 21 of the cover element 2 and a second plurality of grooves 241, 242 comprising a V-shaped cross-section and being provided in the outer surface 21 of the cover element 2. For further clarity the first and second plurality of grooves 231, 232, 241, 242 are shown on the enlarged view of a section of the cover element inserted in FIG. 1. The grooves of the first plurality of grooves 231, 232 and the grooves of the second plurality of grooves 241, 242 intersect each other in an angle of 90°. In alternative embodiments the angle of intersection between the grooves of the first and second plurality of grooves may be different from 90°.

As will be apparent from the below, the second plurality of grooves may in other embodiments be omitted.

The depth of the grooves of the first plurality of grooves, and where present the second plurality of grooves, may be varied, thus providing an extra design parameter for a lighting device according to the invention.

Generally and irrespective of the embodiment, the cover element 2 is arranged such as to extend over the heat sink element 3 in such a way that the first plurality of grooves 231, 232 and where present the second plurality of grooves 241, 242 extends over the plurality of ribs 341, 342, 343, 344 of the second part 32 of the heat sink element 3.

Also, generally and irrespective of the embodiment, the first plurality of grooves 231, 232 and where present the second plurality of grooves 241, 242 extends from the bottom 27 or a position near the bottom 27 of the cover element 2 to the top 26 or a position near the top 26 of the cover element 2.

In the embodiment shown in FIG. 1, the cover element 2 is more specifically arranged such as to extend over the heat sink element 3 in such a way that both each groove of the first plurality of grooves 231, 232 and each groove of the second plurality of grooves 241, 242 extends in an angle of 45° with and over the ribs 341, 342, 343, 344 of the plurality of ribs of the second part 32 of the heat sink element 3.

This is in the embodiment shown in FIG. 1 made possible as both each groove of the first plurality of grooves 231, 232 and each groove of the second plurality of grooves 241, 242 extend along a curved or winding path from the bottom 27 of the cover element 2 to a position near the top 26 of the cover element 2.

The cover element 2 of the lighting device 1 furthermore comprises surface structures 25 in the form of truncated pyramids formed between adjacent pairs of the first and second plurality of grooves. Furthermore, the surface structures 25 are tapering in a direction away from the inner surface 22 of the cover element 2.

In alternative or additional embodiments the surface structures 25 may be in the form of pyramids and/or be provided separately from the first and/or second plurality of grooves. In a particular embodiment at least the surface structures provided in places where the metal cage is not present, i.e. not being provided directly over a rib 341, 342, 343 of the heat sink element 3, are truncated, e.g. in the form of truncated pyramids.

In further alternative or additional embodiments the surface structures 25 may be tapering in a direction towards the inner surface 22 of the cover element 2.

The surface structures 25 have the effect of hiding the direct view to the components directly behind it. The surface structures 25 have proved to do so most effectively when the angle between the surface structure walls, e.g. pyramid walls, and the surface of the cover element 2 is close to 90°.

In an embodiment the cover element 2 is made of a suitable plastic material or in an alternative of glass. In an embodiment the cover element 2 has a minimum thickness of 1 mm.

In the embodiment shown in FIG. 1, the lighting device 1 further comprises a socket element 5, an electronic element 6 for providing electric power to the light sources 4 and a waveguide element 8. The heat sink element 3, and more specifically the first part 31 of the heat sink element 3, further comprises a space 36 adapted for accommodating at least a part of the electronic element 6 as well as a surface 37 adapted for receiving the light sources 4 and, where present, the base 7. The bottom 27 of the cover element 2 is adapted for insertion into the socket element 5. All of these features are optional.

As is apparent from FIGS. 2 and 3, the second part 32 of the heat sink element 3 with its ribs 341, 342, 343, 344 forms in the assembled state a cage-like structure adapted for enclosing the light sources 4, and where provided also the base 7 and the waveguide element 8.

The waveguide element 8 is provided because it enables arranging the light sources 4 in horizontal position with consequential ease of assembly and lowered costs while still achieving a good light distribution. Furthermore the waveguide element 8 maintains the high intensity of direct light sources, which is a requirement for the perception of sparkle effects, it improves the mixing for dimmed tones of the light emitted by the lighting device and it prevents direct view of the light sources 4.

Figure 4:
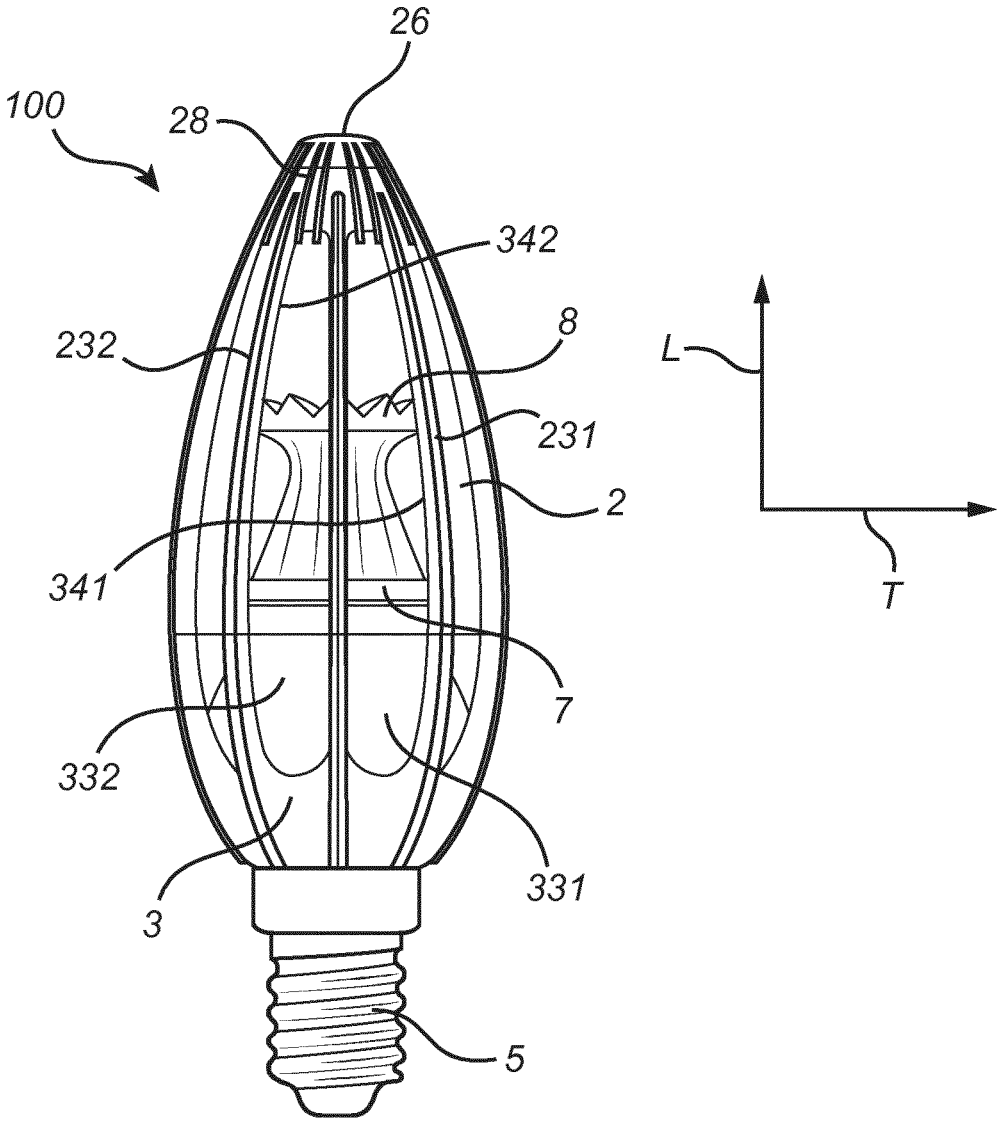
FIG. 4 shows a side view of a lighting device according to a second embodiment of the invention.
Figure 5:
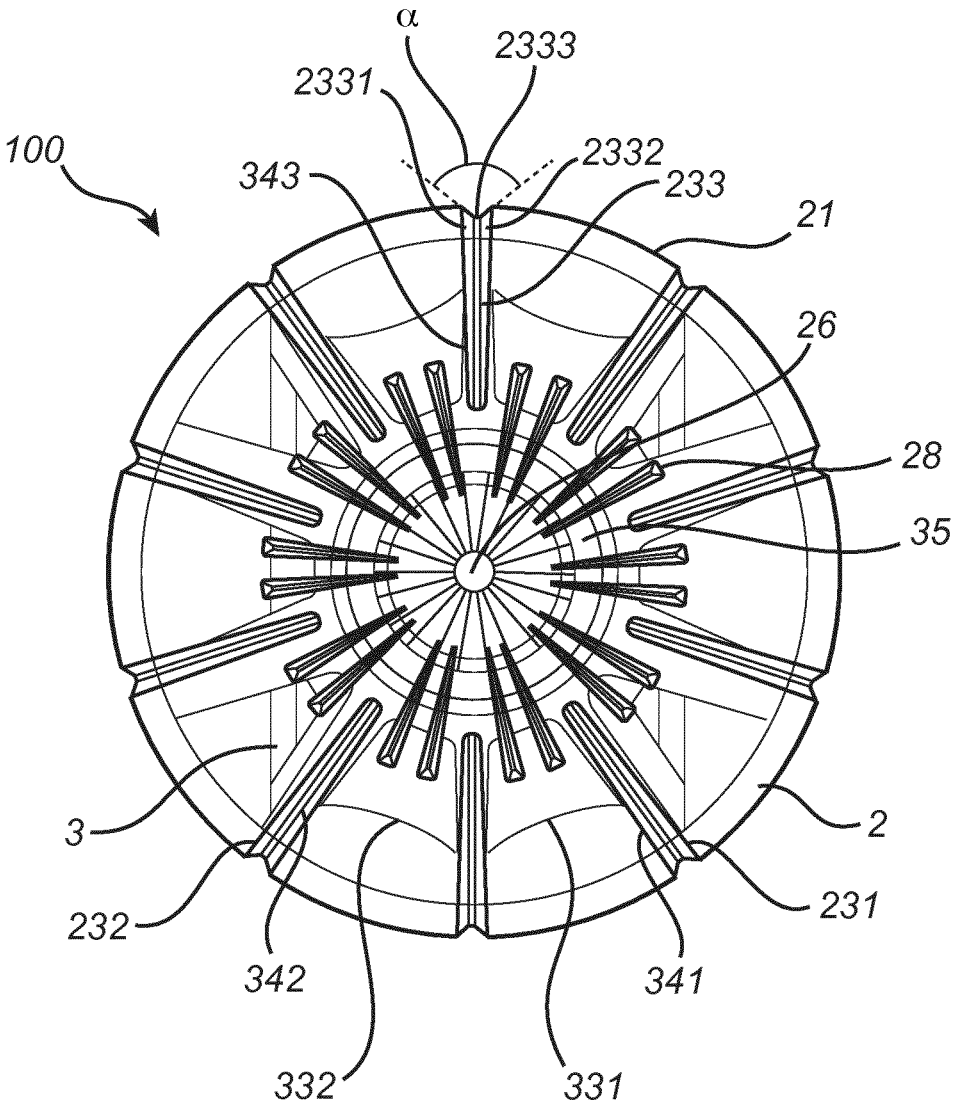
FIG. 5 shows a top view of the lighting device according to FIG. 4.

Turning now to FIGS. 4 and 5 a side view and a top view, respectively, of a lighting device 100 according to a second embodiment of the invention is shown. The lighting device 100 shown in FIGS. 4 and 5 is very similar to that described above in relation to FIGS. 1 to 3, but differs in the following respects.

The cover element 2 of the lighting device 100 is only provided with a first plurality of grooves 231, 232, 233 comprising a V-shaped cross-section and being provided in the outer surface 21 of the cover element 2. The first plurality of grooves 231, 232, 233 are provided as straight grooves extending along the shortest path from the bottom (not visible on FIGS. 2 and 3) of the cover element 2 to a position near the top 26 of the cover element 2.

The cover element 2 of the lighting device 100 is arranged such as to extend over the heat sink element 3 in such a way that each groove of the first plurality of grooves 231, 232, 233 extends in parallel with and directly over a rib of the plurality of ribs 341, 342, 343 of the second part 32 of the heat sink element 3.

Furthermore, the cover element 2 of the lighting device 100 is provided with a further set of grooves 28 provided near and/or at the top 26 of the cover element 2. The grooves 28 may comprise a V-shaped cross-section. The further set of grooves 28 have the effect of providing further hiding of the heat sink 3 and in particular of the top element 35 of the heat sink in case such a top element 35 is provided.

With reference to FIG. 5, and as is illustrated in connection with the groove 233 shown therein, the V-shaped cross-section of the groove 233 comprises two legs 2331, 2332 joined in an apex 2333 in such a way that the two legs 2331, 2332 form an angle α between them. In one embodiment the angle α is 90°. As may also be seen the groove 233 is arranged such that the apex 2333 points towards the heat sink element 3. The groove 233 furthermore comprises a depth measured as the distance from the apex 2333 to a point straight above the apex 2333 and level with the outer surface 21 of the cover element 2.

In fact, and irrespective of the embodiment, each groove of the first plurality of grooves, and where present each groove of the second plurality of grooves, comprises a V-shaped cross-section comprising two legs joined in an apex as well as a depth as described above with reference to the groove 233 shown on FIG. 5, and are also arranged such that their respective apex points towards the heat sink element.

The angle α between the two legs of the V-shaped cross section of the grooves may be varied along the length of a groove and/or between grooves and/or between each of the two pluralities of grooves.

In an embodiment the depth of each groove of the first plurality of grooves, and where present each groove of the second plurality of grooves is at least 0.5 mm.

Figure 6:
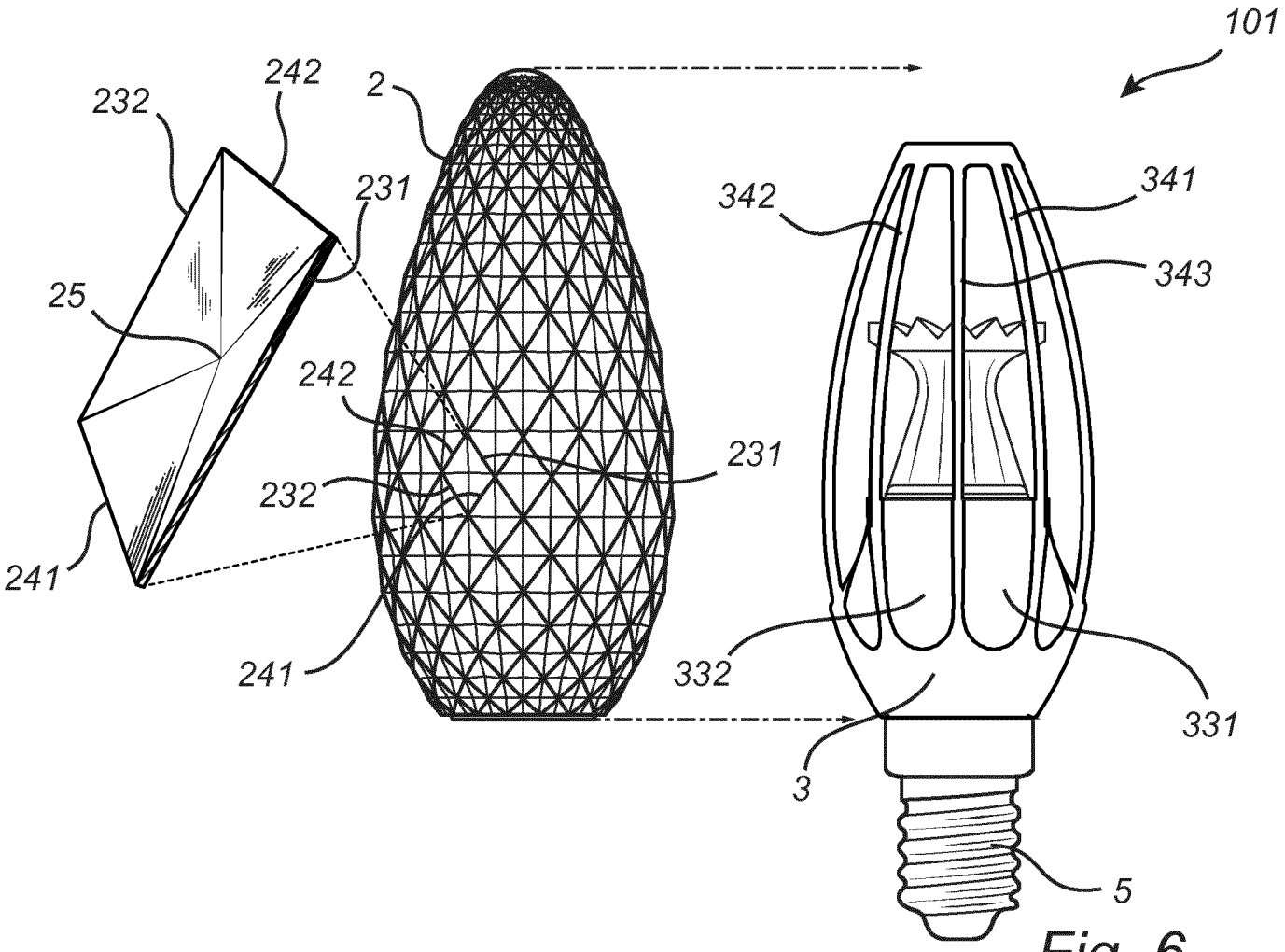
FIG. 6 shows a side view of a lighting device according to a third embodiment of the invention in which the cover element is shown separately for the sake of simplicity, and an enlarged view of a section of the cover element is added for further clarity.

Turning now to FIG. 6 a side view of a lighting device 101 according to a third embodiment of the invention is shown. In FIG. 6 the cover element 2 is shown separately for the sake of simplicity, and an enlarged view of a section of the cover element 2 is added for further clarity. The lighting device 101 shown in FIG. 6 is similar to that described above in relation to FIG. 1, but differs at least in the following respects.

The cover element 2 of the lighting device 101 is provided with a first plurality of ridges 231, 232 and a second plurality of ridges 241, 242 comprising a V-shaped cross-section. The height of the ridges of the first and second plurality of ridges is, however, smaller than the depth of the grooves for the previous embodiments described in relation to FIGS. 1 to 5. In alternative embodiments the second plurality of ridges 241, 242 may be omitted.

The provision of a first and optionally also a second plurality of ridges with a V-shaped cross-section and being provided on or in an outer surface of the cover element provides for a lighting device with which it becomes possible to visually remove at least a part of the heat sink, i.e. to make at least a part of the heat sink invisible seen from a user's point of view, and which is furthermore highly versatile in terms of design options. This effect is for a first and optionally also a second plurality of ridges with a V-shaped cross-section, however, less profound than for grooves.

Furthermore, the cover element 2 comprises a plurality of surface structures 25 shaped as pyramids. In this embodiment the surface structures 25 taper in a direction towards the inner surface 22 of the cover element 2.

Figure 7:
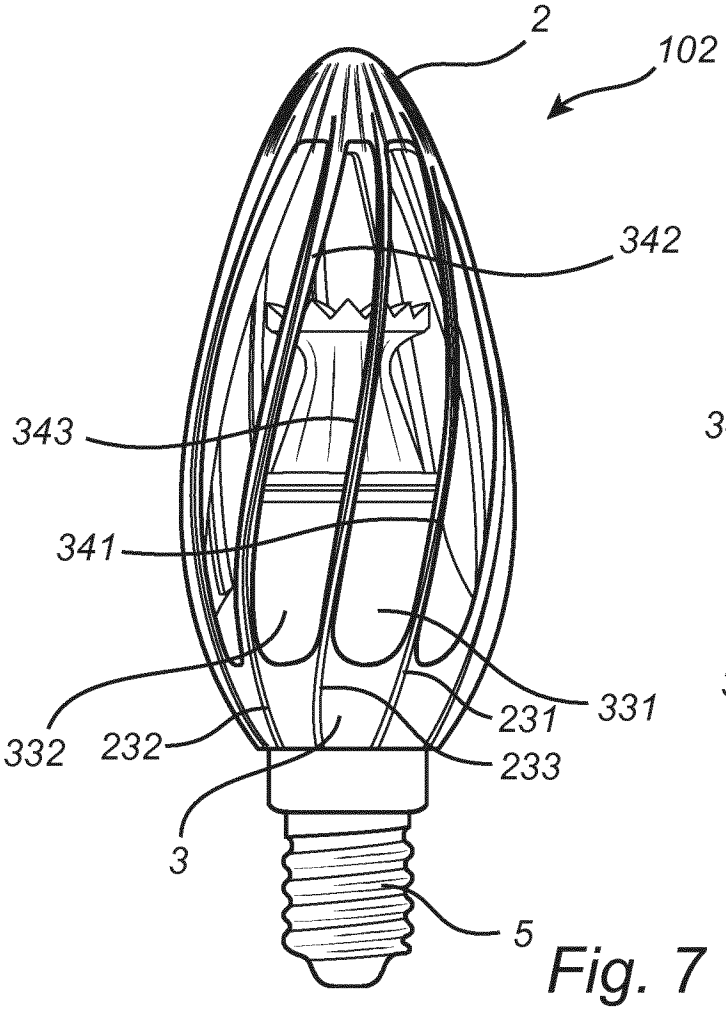
FIG. 7 shows a side view of a lighting device according to a fourth embodiment of the invention.

Turning now to FIG. 7 a side view of a lighting device 102 according to a fourth embodiment of the invention is shown. The lighting device 102 shown in FIG. 7 is very similar to that described above in relation to FIG. 2, but differs at least in the following respects.

The cover element 2 comprises a first plurality of grooves 231, 232, 233 comprising a V-shaped cross-section. In this embodiment both the grooves of the first plurality of grooves 231, 232, 233 and the ribs 341, 342, 343 of the heat sink element 3 extend along a curved or winding path. The grooves of the first plurality of grooves 231, 232, 233 extend from the bottom or a position near the bottom of the cover element 2 to a position near the top of the cover element 2. Likewise, the ribs 341, 342, 343 extend from the first part to the top element of the heat sink element 3.

Furthermore, the cover element 2 of the lighting device 102 is arranged such as to extend over the heat sink element 3 in such a way that each groove of the first plurality of grooves 231, 232, 233 extends in parallel with and directly over a rib of the plurality of ribs 341, 342, 343 of the second part 32 of the heat sink element 3.

Figure 8:
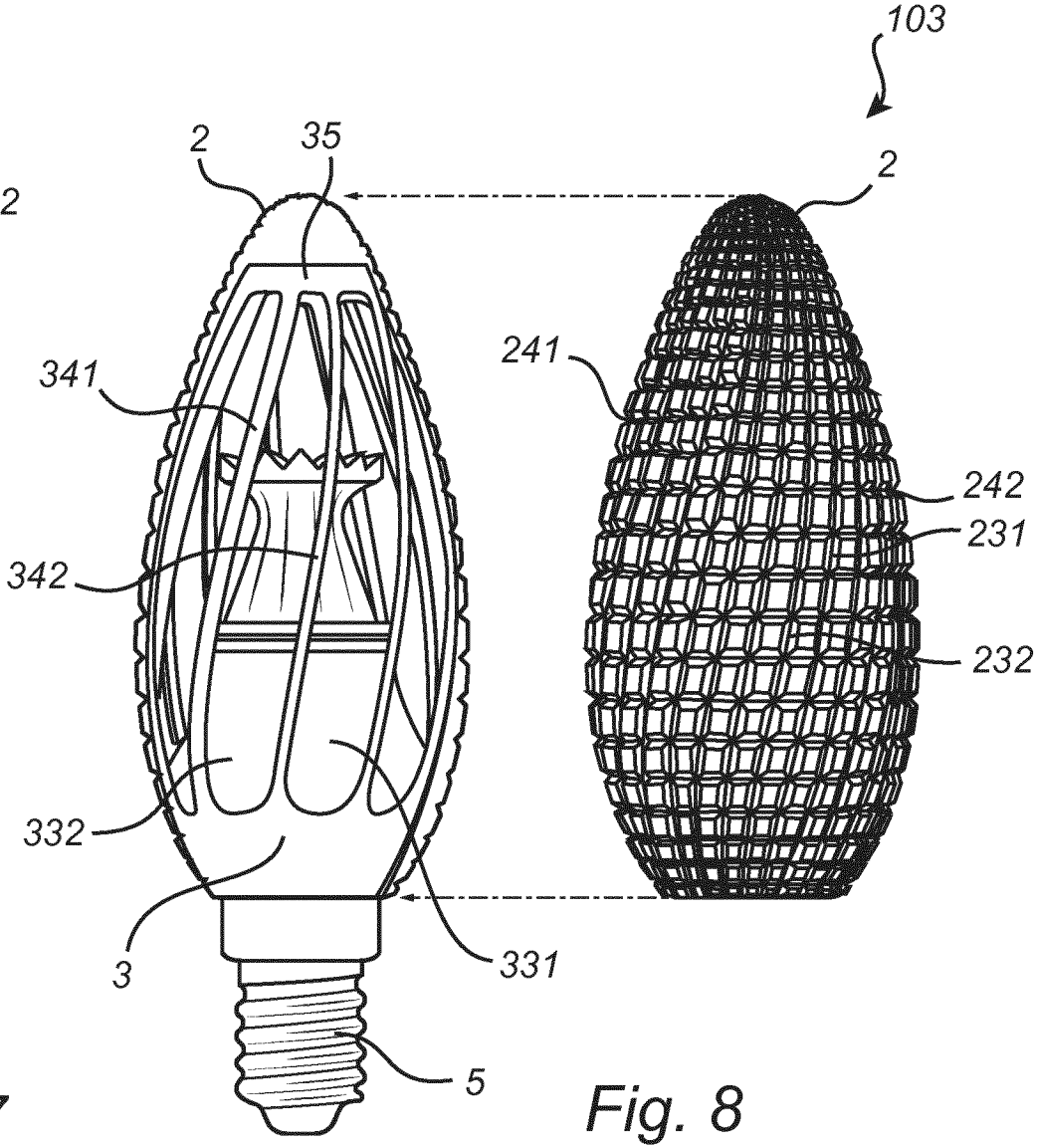
FIG. 8 shows a side view of a lighting device according to a fifth embodiment of the invention in which the cover element is shown separately for the sake of simplicity, and an enlarged view of a section of the cover element is added for further clarity.

Turning now to FIG. 8 a side view of a lighting device 103 according to a fifth embodiment of the invention is shown. The lighting device 103 shown in FIG. 8 is very similar to that described above in relation to FIG. 1, but differs at least in the following respects.

The cover element 2 of the lighting device 101 is provided with a first plurality of grooves comprising a V-shaped cross-section represented by groove 231 and a second plurality of grooves 241, 242 comprising a V-shaped cross-section.

In this embodiment both the grooves of the first plurality of grooves 231 and the ribs 341 of the heat sink element 3 extend along a curved or winding path. The grooves of the first plurality of grooves 231 extend from the bottom or a position near the bottom of the cover element 2 to a position near the top of the cover element 2. Likewise, the ribs 341 extend from the first part to the top element of the heat sink element 3.

The grooves of the second plurality of grooves 241, 242, however, are straight and extend along the periphery of the cover element 2 in a horizontal or transversal direction T.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting device comprising:

at least one light source adapted for, in operation, emitting light, a heat sink element comprising a first part on which the at least one light source is arranged and a second part, the second part comprising a plurality of ribs extending from the first part, and wherein the second part joins the plurality of ribs at an end opposite the first part, and a cover element extending over the heat sink element, the cover element comprising an outer surface adapted for forming a light exit surface of the lighting device, the cover element comprising a first plurality of grooves comprising a V-shaped cross-section and being provided in the outer surface of the cover element, and wherein the cover element further comprises a second plurality of grooves comprising a V-shaped cross-section and being provided in the outer surface of the cover element and arranged such that the grooves of the second plurality of grooves intersect the grooves of the first plurality of grooves in an angle being different from zero, the cover element being arranged such as to extend over the heat sink element in such a way that the first plurality of grooves and the second plurality of grooves extends over the plurality of ribs of the second part of the heat sink element.

2. A lighting device comprising:

at least one light source adapted for, in operation, emitting light, a heat sink element comprising a first part on which the at least one light source is arranged and a second part, the second part comprising a plurality of ribs extending from the first part, and wherein the second part joins the plurality of ribs at an end opposite the first part, and a cover element extending over the heat sink element, the cover element comprising an outer surface adapted for forming a light exit surface of the lighting device, the cover element comprising a first plurality of grooves comprising a V-shaped cross-section and being provided in the outer surface of the cover element, the cover element further comprises a plurality of surface structures between adjacent pairs of the first and second plurality of grooves for hiding at least a portion of the heat sink element, the cover element being arranged such as to extend over the heat sink element in such a way that the first plurality of grooves extends over the plurality of ribs of the second part of the heat sink element, and in such a way that each groove of the first plurality of grooves extends in parallel with and directly over a rib of the plurality of ribs of the second part of the heat sink element.

3. A lighting device according to claim 1, wherein the first part of the heat sink element comprises a plurality of indentations provided in such a way as to extend between the ribs.

4. The lighting device according to claim 1, wherein the V-shaped cross section of each groove of the first and/or second plurality of grooves comprises two legs joined in an apex, and wherein the first and/or second plurality of grooves are arranged such that the apex point towards the heat sink element.

5. The lighting device according to claim 1, wherein the ribs of the plurality of ribs of the heat sink element are spaced apart with a distance being in the order of 8 mm.

6. The lighting device according to claim 1, wherein the cover element is arranged such as to extend over the heat sink element in such a way that each groove of the first plurality of grooves extends in an angle of 45° with and over the ribs of the plurality of ribs of the second part of the heat sink element and that each groove of the second plurality of grooves extends in an angle being different from zero with and over the ribs of the plurality of ribs of the second part of the heat sink element.

7. The lighting device according to claim 1, wherein the cover element comprises a bottom and a top and wherein at least one of the grooves of the first and/or second plurality of grooves are extending from the bottom or a position near the bottom to the top or a position near the top.

8. The lighting device according to claim 1, wherein the cover element comprises a bottom and a top and wherein at least one of the ribs of the plurality of ribs and the grooves of the first and/or second plurality of grooves are extending along the shortest path from the bottom or a position near the bottom to the top or a position near the top.

9. The lighting device according to claim 1, wherein the cover element comprises a bottom and a top and wherein at least one of the ribs of the plurality of ribs and the grooves of the first and/or second plurality of grooves are extending along a curved or winding path from the bottom or a position near the bottom to the top or a position near the top.

10. The lighting device according to claim 1, wherein the cover element further comprises a plurality of surface structures arranged on the outer surface of the cover element.

11. The lighting device according to claim 10, wherein the plurality of surface structures are shaped as a pyramid or a truncated pyramid.

12. The lighting device according to claim 11, wherein the plurality of surface structures being shaped as a pyramid or a truncated pyramid comprise a top angle of between 60° and 120°.

13. The lighting device according to claim 10, wherein the plurality of surface structures taper in any one of a direction towards an inner surface of the cover element and a direction away from an inner surface of the cover element.

14. The lighting device according to claim 1, wherein the second part of the heat sink element further comprises a top element joining at least some of the ribs of the plurality of ribs at an end opposite to the first part.

15. The lighting device according to claim 1, the cover element further comprises a plurality of surface structures between adjacent pairs of the first and second plurality of grooves for hiding at least a portion of the heat sink element.

* * * * *